US005515922A

United States Patent [19]

Ruttley

[11] Patent Number: 5,515,922

[45] Date of Patent: May 14, 1996

[54] RECOVERY TOOL

[75] Inventor: David J. Ruttley, Marrero, La.

[73] Assignee: Rattler Tools, Inc., Harvey, La.

[21] Appl. No.: 353,107

[22] Filed: Dec. 9, 1994

[51] Int. Cl.[6] ..... E21B 31/00

[52] U.S. Cl. ..... 166/301; 166/177.6

[58] Field of Search ..... 166/301, 177, 166/178, 177.6

[56] References Cited

U.S. PATENT DOCUMENTS

| | | | |
|---|---|---|---|
| 2,730,176 | 1/1956 | Herbold | 166/301 X |
| 3,049,185 | 8/1962 | Herbold | 166/177 X |
| 3,155,163 | 11/1964 | Bodine, Jr. | 166/301 |
| 3,168,140 | 2/1965 | Bodine, Jr. | 166/301 |
| 4,323,119 | 4/1982 | Bodine | 166/177 |
| 4,667,742 | 5/1987 | Bodine | 166/301 |
| 4,846,273 | 7/1989 | Anderson et al. | 166/178 |
| 4,913,234 | 4/1990 | Bodine | 166/301 |

*Primary Examiner*—Hoang C. Dang
*Attorney, Agent, or Firm*—Keaty & Keaty

[57] ABSTRACT

This invention relates to a tool for recovering a downhole equipment stuck in the formation. The tool provides for the use of a power source mounted a distance above the equipment to be recovered. An elongated shaft is rotationally connected to the power source, the shaft having unbalanced weight which is distributed over at least a part of its length. When the power source transmits torque to the shaft, the shaft begins to vibrate, transmitting the vibration to the downhole equipment which causes loosening of the soil surrounding the equipment and facilitates recovery of the equipment.

14 Claims, 1 Drawing Sheet

RECOVERY TOOL

BACKGROUND OF THE INVENTION

This invention relates to a well drilling equipment, and more particularly to an apparatus designed to facilitate recovery of downhole equipment stuck in a downhole formation and/or cased hole.

During drilling operations, there is an ever present danger of a drill pipe being stuck in the well bore without the possibility of recovering the drill string with the help of conventional equipment. Some of the conventional methods of recovery of such equipment utilize reciprocating movement of a work string, moving the pipe up and down in an effort to recover the stuck equipment. Another method utilizes rotational movement by importing torque to the pipe in a clockwise or counter-clockwise direction. A third method employs circulating fluids around the downhole equipment to facilitate recovery of that equipment.

While the above described conventional methods work satisfactory under many conditions, there are still a number of areas wherein utilization of any of the above methods alone results in a limited success. For example, a drill string can get stuck in a dehydrated mud in a cased hole, or the tubing becomes stuck in the sand or other dense formation. In such cases, the recovery of the equipment becomes a long, labor-consuming process which adversely affects the efficiency of the drilling operation and is costly.

The present invention contemplates provision of a system for recovery of equipment which can be used in conjunction with conventional methods or alone.

SUMMARY OF THE INVENTION

It is, therefore, an object of the present invention to provide a tool for recovery of downhole equipment which utilizes vibration as the main force applied during its operation.

It is another object of the present invention to provide an downhole equipment recovery tool which is easy to install and operate.

It is a further object of the present invention to provide a tool for recovery of downhole equipment which can be successfully used in different types of formations.

These and other objects of the present invention are achieved through a provision of a recovery tool which is adapted for positioning in a work string in a downhole location above the equipment to be recovered. The recovery tool comprises an elongated hollow housing for enclosing a power source suitable for producing rotational movement. An elongated shaft extends downwardly from the power source and receives torque when the power source is activated. The elongated shaft has unbalanced weight distributed over at least a part of its length. The unbalanced weight is produced by a dead weight member, or a heavy mass core made, for example, from lead, which is mounted on one side of the shaft and extends in a substantially parallel relationship to its longitudinal axis. When the shaft rotates, the unbalanced weight causes the shaft and the housing to vibrate, transmitting the vibrating motion to the work string, and particularly to the equipment being recovered. This vibrating motion causes the tool being recovered to move in an irregular manner, for example in an elliptical motion, contacting the formation which surrounds the equipment and loosening the soil in the immediate area surrounding that part of the equipment. As a result, the recovery of the equipment from the downhole position is facilitated.

An unwanted transmittal of vibration upstream, that is above the power source, is prevented by dampening the vibrating force through the use of an accelerator mounted upstream from the housing. The housing is selectively positionable and recoverable from the downhole location through the use of standard tool joints above and below the housing.

BRIEF DESCRIPTION OF THE DRAWINGS

Reference will now be made to the drawings, wherein like parts are designated by like numerals, and wherein.

DETAIL DESCRIPTION OF THE PREFERRED EMBODIMENT

Figure 1:
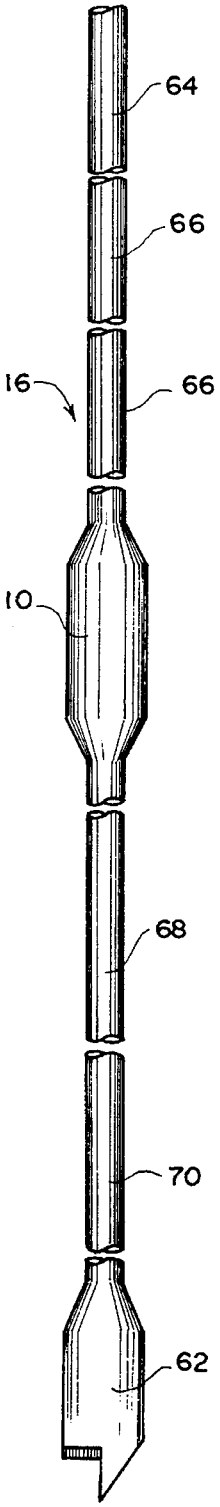
FIG. 1 is a schematic view illustrating the position of the apparatus of the present invention as part of a conventional work string.

Turning now to the drawings in more detail, the device of the present invention is designated by numeral 10 in the drawings. The tool 10 comprises a hollow cylindrical body 12 which defines an interior chamber 14 therein. The body 12 is oriented vertically when it is positioned for operation as part of a drill string 16 and has an upper portion 18 and a lower portion 20. The portions 18 and 20 are formed with threads, such as 22 and 24, to allow engagement of the housing 12 with a standard tool joint with a fish neck 26, at its upper end, and to a standard tool joint 28 at its lower end.

Mounted in the upper portion 18 is a high pitch motor which is activated by pump pressure from the surface transmitted by rig pumps through a conduit 32 formed in the tool joint 26. Extending downwardly from the motor 30 and operationally connected thereto is an central elongated shaft 34 which receives rotational movement from the motor 30 when activated by a fluid from the surface.

Fixedly secured to a side of the shaft 34 and extending through the middle part thereof is an off-balancing mass, or weight 36 which can be made from lead or other high density, heavy material suitable for use in subterranean environment. The middle part of the housing 12 where the weight 36 is positioned is isolated from the remainder of the housing by upper inner seals 40 and lower inner seals 42. A pair of ball bearing assemblies 44 and 46 are mounted on the shaft 34 in the upper and lower portions thereof.

A plurality of circumferentially spaced circulation ports 50 are formed to allow circulation fluid to exit the housing 12. A service break 52 is formed in the housing 12 to allow separation of the portion of the housing 12 which contains the motor 30 from the remainder of the apparatus. The service break comprises a threaded joint to allow the tubing to be open to position the elements of the apparatus therein.

A means for diverting fluids 54 is positioned on top of the motor 30, the diverting means comprising a glass disc or a dart with jet "retrievable." The disc allows to divert the fluid downwardly, from the tool joint 26 to the motor 30 and outwardly through the circulation port 50. If the dart is used, it can be retrieved with a wireline to allow easy access to the portion wherein the motor 30 is located. If the glass disc is used, it can be simply broken to allow access to the motor 30.

Figure 2:
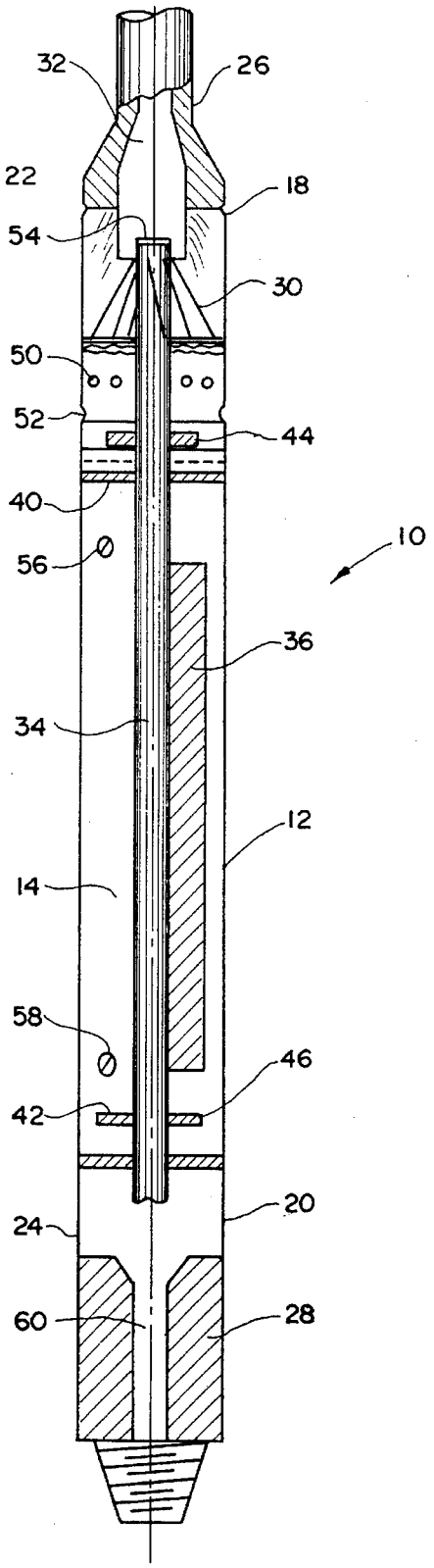
FIG. 2 is a schematic view of the apparatus in accordance with the present invention.

At least one opening is made in the housing 12 to allow cleanout of the housing. The embodiment shown in FIG. 2 illustrates two of such openings fitted with set screws which are designated by numerals 56 and 58 in the drawing. The tool joint 28 is provided with a conduit 60 extending through the length thereof and communicating with a shaft 34 to allow entry of a wireline into the shaft 34 from the bottom end of the housing.

When the motor imparts rotation to the shaft 34, the lead core, or weight 36 will tend to pull the shaft away from its vertical orientation and cause the entire housing 12 to vibrate, transmitting that vibration along the drill string 16. In an exemplary arrangement, the device 10 is positioned above a drill bit 62 is an illustration of a fishing tool "overshot." The vibration force causes the member 62 to move in an irregular pattern resembling an oval or elliptical pattern, pressing against the formation which surrounds the member 62 and loosening its "gripping" hold on the member 62.

Since it is important to impart vibration only on the downstream equipment 62, but not to the up stream equipment, an accelerator member 64 is positioned above the housing 12 to dampen the vibration and to prevent the vibration from reaching upper subs of the drill string. In an exemplary order of running the apparatus 10, the string can be assembled by positioning the accelerator jar 64, one or more drill collars 66 below the accelerator 64, the apparatus 10, an oil jar 68 below the apparatus 10, a bumper jar 70 below the oil jar 68 and an overshot, for example Bowen overshot 62, below the bumper jar 70. The member 62 can be either a spear or other equipment, depending upon the particular application. The accelerator jar must be first run to dampen vibration on the upper work string. This will also divert vibration downward, toward the object which must be recovered. It is also advisable to pre-test the recovery tool in a vertical position and run it through a rotation cycle before positioning it as part of the string. It is preferable to run the recovery tool without the disc or dart 54 to allow 80% of the fluid to pass through the tube and 20% of fluid to pass through the circulation port.

In operation, when recovery of a downhole tool is required, the recovery tool 10 is positioned in place of one of the subs close to the member which needs to be recovered. The accelerator 64 is positioned above the tool 10, and pump pressure is transmitted to the motor 30 to initiate rotation of the shaft 34. The off-center weight 36 will cause the entire tool 10 to "vibrate", transmitting this irregular motion to the downstream portion of the work string thereby facilitating recovery of the stuck equipment. If the recovery of the equipment is still not accomplished, the work string can be reassembled to move the recovery tool 10 further downstream and run the cycle again until the full recovery is achieved.

The motor 30 can be a screw-type rotating member instead of an impeller, if desired. It is also possible to select motor 30 strong enough to impart sufficient vibration to the object to be recovered so that no subsequent operations are required. It is also envisioned that a screw type turbine can be substituted for the shaft-and-up weight arrangement.

The recovery tool 10 in accordance with the present invention can be used to facilitate release of sand stuck tubing, for release of screened liners without using conventional washover, to free packers or over shot that have become frictionally stuck after prolonged use in the well bore. The tool can also be used in milling operations to increase footage and prolong the mill life. Similarly, it can be run with gravel pack assembly to increase a tight gravel pack, to remove stuck tubing hangers that have been in the well for a long period of time. The recovery tool 10 can also be run with tubing conveyed perforating gun. These guns often become stuck after firing. The tool 10 can be activated by pump pressure allowing complete recovery.

Many changes and modifications can be made within the design of the present invention without departing from the spirit thereof. I, therefore, pray that my rights to the present invention be limited only by the scope of the appended claims.

I claim:

1. An apparatus for recovering a downhole equipment, comprising:

a hollow housing with an interior chamber formed therein, said housing having an upper portion, a middle portion and a lower portion;

a means mounted in the upper portion for providing rotational force, comprising a motor adapted for positioning in a subterranean location;

an elongated central shaft extending from and operationally connected to said means for providing rotational force at its upper end and to the downhole equipment to be recovered at its lower end;

a means for sealing the middle portion from said upper portion and said lower portion;

means mounted in said middle portion for offsetting balanced rotation of the shaft to cause said shaft to vibrate such that the vibrating motion is transmitted to the downhole equipment;

means formed in said upper portion for allowing circulation of fluid through said housing, said means comprising a plurality of openings formed in said upper portion below said motor; and means mounted on top of said motor for diverting fluid flowing through said housing to said means for allowing circulation of fluid.

2. The apparatus of claim 1, wherein said means for offsetting balanced rotation comprises a weight member fixedly attached to one side of the shaft.

3. The apparatus of claim 2, wherein said weight member comprises an elongated body extending in substantially parallel relationship to a longitudinal axis of the shaft.

4. The apparatus of claim 1, wherein said means for diverting fluid comprises a retrievable dart member.

5. The apparatus of claim 1, further comprising means for dampening the vibrating motion upstream from said means for providing rotational force.

6. The apparatus of claim 5, wherein said dampening means comprises an accelerator means.

7. An apparatus for recovery of a downhole equipment, comprising:

a cylindrical hollow housing with an interior chamber formed therein, said housing having an upper portion, a middle portion and a lower portion, said housing being adapted for connecting to a work string in a subterranean location;

a power source mounted in the upper portion in said housing;

a elongated central shaft operationally connected to said power source at its upper end for receiving torque from said power source and connectable to the downhole equipment to be recovered at its lower end;

an unbalancing weight member fixedly attached to one side of the shaft, said member causing unbalanced rotation of said shaft when the shaft rotates, thereby producing a vibration which is transmitted to a downhole equipment, said vibration of the downhole equipment causing loosening of formation surrounding the downhole equipment and facilitating recovery of the equipment;

a means for sealing the middle portion from said upper portion and said lower portion;

means for allowing circulation of fluid through said housing, said circulation means comprising a plurality of openings formed in said upper portion below said power source; and a means mounted on top of said power source for diverting fluid flowing through said housing to said plurality of openings, said diverting fluid means comprising a retrievable dart member.

8. The apparatus of claim 7, wherein said unbalancing weight member comprises an elongated body which extends in a substantially parallel relationship to a longitudinal axis of said shaft.

9. The apparatus of claim 7, wherein said housing is mounted upstream from the equipment to be recovered.

10. The apparatus of claim 7, further comprising means for dampening said vibration upstream from said housing.

11. The apparatus of claim 10, wherein said dampening means comprises an accelerator mounted above said housing.

12. A method of recovering equipment stuck in a downhole formation, comprising the steps of:

providing a power source and positioning said power source in a housing a distance above said equipment;

providing an elongated shaft rotationally connected to said power source, said shaft having unbalanced weight distributed over at least a part of its length;

initiating rotation of said elongated shaft to produce vibration which is transmitted to said equipment being recovered, such that irregular movement of said equipment causes loosening of formation surrounding said equipment and facilitates recovery of the equipment;

providing a means for selectively diverting fluid flowing into said housing to said power source; and providing means for allowing circulation of fluid below the power source to the exterior of the housing.

13. The method of claim 12, further comprising the step of providing means for dampening the vibrating motion upstream from said power source.

14. The method of claim 13, wherein said dampening means comprises an accelerator means mounted above said power source.

* * * * *